United States Patent [19]

Cormany

[11] 4,065,323

[45] Dec. 27, 1977

[54] DEGREASING PROCESS USING STABILIZED METHYLCHLOROFORM SOLVENT

[75] Inventor: Charles L. Cormany, Wadsworth, Ohio

[73] Assignee: PPG Industries, Inc., Pittsburgh, Pa.

[21] Appl. No.: 723,876

[22] Filed: Sept. 16, 1976

[51] Int. Cl.[2] ..... B08B 3/08; B08B 7/04

[52] U.S. Cl. ..... 134/10; 134/11; 134/40; 260/652 P; 260/652.5 R

[58] Field of Search ..... 134/10, 11, 40; 260/652 P, 654 S, 652.5 R; 210/21

[56] References Cited

U.S. PATENT DOCUMENTS

| | | | |
|---|---|---|---|
| 2,152,166 | 3/1939 | Yabroff | 260/652 P X |
| 2,371,644 | 3/1945 | Petering et al. | 260/652.5 R X |
| 2,467,394 | 4/1949 | Lovell et al. | 260/652 P X |
| 3,060,125 | 10/1962 | Sims | 260/652.5 R X |
| 3,209,040 | 9/1965 | Daras et al. | 260/654 S |
| 3,452,110 | 6/1969 | Cooley et al. | 210/21 X |
| 3,772,082 | 11/1973 | Dunn | 134/11 X |

*Primary Examiner*—S. Leon Bashore
*Assistant Examiner*—Marc L. Caroff
*Attorney, Agent, or Firm*—Roger S. Benjamin; William M. Dooley; Edward J. Whitfield

[57] ABSTRACT

The pH and acid acceptance of methylchloroform solvent is maintained by contact with a continuous phase of polyhydroxy alcohol.

8 Claims, No Drawings

DEGREASING PROCESS USING STABILIZED METHYLCHLOROFORM SOLVENT

BACKGROUND OF THE INVENTION

Methylchloroform is an outstanding solvent and finds wide application in cleaning and degreasing operations. Stabilizers are usually compounded with methychloroform to give solvent systems which are resistant to the degradation of methylchloroform into by-products such as hydrogen chloride and acetic acid. The tendency for such degradation is especially pronounced in the presence of metals or moisture.

Despite the initial resistance of stabilized methylchloroform systems to decomposition, it is usual for acidity to develop over long periods of continual use. Although solvent contaminants may be removed by processes such as filtration or redistillation, the stabilization capacity of the solvent systems (its ability to accept acids and render them harmless) is gradually diminished. The development of an acidic environment (e.g., such as results from the presence of free hydrochloric acid or acetic acid) is particularly detrimental to the cleaning of metals because it may result in corrosion or the appearance of etched surfaces.

U.S. Pat. No. 3,209,040 (patented Sept. 28, 1965) describes a process for treating trichloroethylene or perchloroethylene to remove oxidation products by intimate mixing with an aqueous solution of a polyol for a period of 15 to 60 minutes, then cooling followed by separation of an aqueous phase.

U.S. Pat. No. 3,360,474 (patented Dec. 26, 1967) and U.S. Pat. No. 3,452,110 (patented June 24, 1969) describe compositions of filtering powder, polyhydroxy alcohol, and an inorganic base for treatment of drycleaning fluids. This composition is maintained as a suspension in the drycleaning fluid for approximately 15 minutes and separated by filtration.

It is desirable to develop a process to continuously and conveniently maintain over long operating periods the pH and acid acceptance of methylchloroform solvent employed in cleaning and degreasing operations.

THE INVENTION

This invention concerns the purification of methylchloroform solvent. This invention is also an improved method of cleaning and degreasing articles with methylchloroform solvent. This invention deals with continuously and conveniently maintaining the pH and acid acceptance of methylchloroform solvent over long periods of use especially in the presence of moisture and metals.

It is a further discovery of this invention that the stability of epoxide stabilized methylchloroform solvent is not impaired by this invention.

The objects of this invention are accomplished by contacting methylchloroform with a polyhydroxy alcohol. In particular, methylchloroform solvent is contacted with a continuous phase of substantially immiscible polyhydroxy alcohol having a density less than methylchloroform. Polyhydroxy alcohol treated methylchloroform may be continuously withdrawn as a separate phase from the polyhydroxy alcohol and reused in a cleaning operation.

DETAILED DESCRIPTION OF THE INVENTION

Methylchloroform solvent is composed predominantly of methylchloroform (1,1,1-trichloroethane). The solvent will generally also contain one or more of a wide variety of stabilizers known in the art to resist methylchloroform decomposition and development of acidity. Generally stabilizers constitute less than 5 weight percent, and more often less than 2 weight percent of the methylchloroform solvent with the balance of the solvent being methylchloroform. Stabilizer ingredients suitable for inclusion into methylchloroform solvents are typified by those set out in U.S. Pat. No. 3,397,148 to G. N. Grammer, et al; U.S. Pat. No. 3,251,891 to C. L. Cormany, et al; U.S. Pat. No. 3,661,788 to A. Campbell, et al and U.S. Pat. No. Re. 26,025 (reissued May 17, 1966) to O. S. Kander et al. Exemplary stabilizers include amines such as diisopropylamine or tertbutyl amines and epoxides such as butylene oxide or epichlorohydrin.

It is generally desirable for methylchloroform solvent to have an approximately neutral pH; generally a pH between 6.3 and 7.7 is acceptable. In addition, the solvent (under conditions of use) must have the capacity to accept a moderate quantity of acidic materials incident to employment in cleaning operations. This capacity is expressed as total acid acceptance (as defined as ASTM Test Method D 2942-71T) and should not be below 0.06 weight percent NaOH and is desirably between 0.1 to 0.9 weight percent NaOH.

Polyhydroxy alcohols suitable for use in this invention have a density less than methylchloroform (or methylchloroform solvent) and are liquids within the temperature range at which contact is made with methylchloroform solvent, typically between 15° C. and 60° C. The solubility of the selected polyhydroxy alcohol in the solvent must be low to avoid too rapid consumption of alcohol or pronounced alteration of the solvent composition. Conversely the polyhydroxy alcohol's affinity for water must be high to encourage retention of water contained in the solvent. Desirably, the polyhydroxy alcohol has a solubility in methylchloroform of less than 5.0 percent by volume and has an affinity for water characterized by a water solubility in excess of 20 percent by weight. Examples of suitable polyhydroxy alcohols are glycerol, diethylene glycol, propylene glycol, ethylene glycol, and triethylene glycol, with glycerin being particularly preferred. A mixture of polyhydroxy alcohols may also be employed . It is necessary that the lower density alcohol phase contain only polyhydroxy alcohol absent particulate materials which interfere with ease of phase separation. The relative proportion of polyhydroxy alcohol to methylchloroform solvent may vary over wide limits. Typical practice will employ the polyhydroxy alcohol at between 0.001 and 2 volume percent of the methylchloroform solvent in a solvent cleaning apparatus.

The contact of methylchloroform solvent with polyhydroxy alcohol is accomplished by introducing solvent into a continuous phase of the alcohol. The extent of solvent contact with the polyhydroxy alcohol can be adjusted by (1) degree of subdivision of solvent phase in the alcohol, by (2) the degree of agitation while in the alcohol and by (3) duration of contact with the alcohol. An increase of any of these three factors will increase the effectiveness of the polyhydroxy alcohol treatment. It is intended that the continuous phase of polyhydroxy alcohol provide a zone of rapid and concentrated treatment for the solvent. Conditions which promote the formation of emulsions or fine dispersions prolong separation of a treated solvent phase and are discouraged. An especially advantageous embodiment of the invention is to introduce solvent into a column of polyhydroxy alcohol. The duration of solvent treatment (contact with the alcohol) is a function of column height of alcohol through which the denser solvent settles. The accumulated solvent bottom layer is treated solvent which may be withdrawn for reuse in a cleaning operation.

Suitable contact times for the methylchloroform solvent and polyhydroxy alcohol can be determined by monitoring the pH and total acid acceptance of the solvent; however, contact times between 0.5 second and 1 minute are generally adequate.

The temperature of solvent treatment is not critical. Contact of the methylchloroform solvent and polyhydroxy alcohol is conveniently done at any temperature below the boiling point of the solvent and more usually between 0° C. and 70° C.

The treatment of methylchloroform solvent with polyhydroxy alcohol is done at a location separate from the cleaning zone, since the presence of significant amounts of polyhydroxy alcohol as a discontinuous immiscible phase in the methylchloroform solvent is undesirable for cleaning operations. In most instances, the solvent/alcohol contact and the phase separation of the solvent layer from the alcohol treatment layer are accomplished in the same piece of apparatus.

The treatment of the solvent with polyhydroxy alcohol according to this invention may optionally be combined with a water removal step. Water solubilized during the cleaning operation is conveniently removed by lowering the temperature of the solvent and permitting the excluded water to separate and accumulate as a lower density upper phase above the solvent. A water removal step is most advantageously done before solvent treatment with the polyhydroxy alcohol since the polyhydroxy alcohol will tend to preferentially remove water by virtue of its comparatively high water solubility. It is preferred that the polyhydroxy alcohol contain less than 10 percent by weight of absorbed water. The polyhydroxy alcohol may be processed for reuse by a method such as thermal fractionation.

EXAMPLE I

This example illustrates the practice of the invention:

A model MLW-120 stainless steel Baron-Blakeslee vapor-immersion degreaser unit was used in this experiment. The degreaser configuration comprises a solvent feed inlet for carrying 65° C. to 74.1° C. methylchloroform solvent into a 25.4 cm. by 30.4 cm. rinse tank. The rinse tank was arranged so its continuous overflow falls to an adjacent boiling sump measuring 25.4 cm. by 30.4 cm. The rinse tank was maintained at a temperature of 68° C. to 70° C. The boiling sump provided vaporized solvent for vapor phase degreasing. The vaporized solvent was condensed by cooling coils surrounding the interior of the apparatus and withdrawn from the degreaser unit. The withdrawn solvent was first cooled to 23° C. and the excluded phase water separated in a 10.2 cm. diameter phase separator having a solvent inlet and bottom oulet and an upper water phase removal outlet. Thereafter, the partially dewatered solvent from the bottom of the phase separator was sent to a compartmented 12.7 cm. by 12.7 cm. by 30.5 cm. deep box containing 200 c.c. of glycerol in a 10.2 cm. by 30.5 cm. deep compartment. Solvent was introduced into the top of the glycerol layer and withdrawn for return to the degreaser via a bottom outlet as a settled phase.

45.4 liters of methylchloroform solvent stabilized with diisopropylamine and butylene oxide were placed in the above-described degreaser unit. One liter of 2024 aluminum turnings were placed in both the boiling sump and rinse tank. During operation of the degreaser, distilled water was added dropwise to the boiling sump from a 500 ml. separatory funnel suspended above the sump. Approximately four liters of makeup solvent was added to the boiling sump once each week. The solvent in the boiling sump contained 0.5% (by volume) of Atpet 200 (Atlas Chemical Ind., Inc.; mixture of sorbitan partial fatty esters) to assist water dispersion in the solvent.

Three sets of test panels were prepared. Each set contained a copper, galvanized steel, 2024 aluminum, mild steel, and 316 stainless 3 × 5 inches steel panel. One set of panels was hung in the vapor zone, one set was half-immersed in the boiling sump solvent, and the last set was half-immersed in the rinse tank.

Solvent samples were periodically taken from the boiling sump and rinse tanks for analysis to determine the solvent's pH, titer, and acid acceptance.

The results of the analysis are found in Table 1:

TABLE 1

Solvent Stability During Long Term Vapor Degreasing

| Hours Operation | Total Mls. $H_2O$ Added | Boiling Sump pH[6]/Titer | Boiling Sump Acid[7] Acceptance | Rinse Tank Acid[5] Acceptance |
|---|---|---|---|---|
| 0.0[1] | 0 | 6.6/0.6 | 0.159% | — |
| 22.3 | 0 | — | — | — |
| 22.9[2] | 0 | — | — | — |
| 167.3 | 4000 | 6.65/0.4 | 0.141% | 0.174% |
| 238.9[3] | 7000 | 6.5/0.5 | 0.135% | 0.166% |
| 310.6[4] | 8000 | — | — | — |
| 315.7 | 8500 | 6.45/9.6 | 0.129% | 0.172% |
| 453.5 | 12000 | 6.75/0.2 | 0.114% | 0.145% |
| 549.7 | 16000 | 6.55/0.4 | 0.120% | 0.157% |
| 645.4 | 18000 | 6.5/0.4 | 0.108% | 0.136% |
| 789.5 | 22000 | 6.6/0.3 | 0.105% | 0.145% |
| 862.7 | 25000 | 6.0/0.5 | 0.099% | 0.121% |
| 864.4 | 25000 | | RUN TERMINATED | |

[1] Operation begun. Metal test panels placed in degreaser. Initial pH 6.6, Initial Titer 0.6.
[2] $H_2O$ addition begun.
[3] Glycerol layer yellow in color.
[4] Unit temporarily shut down.
[5] Acid acceptance - ASTM D 2942-71 T.
[6] pH ASTM 2110-64 (1971).
[7] Titer ASTM D 2989-71 T.

It is evident that treatment of methylchloroform solvent with a continuous phase of polyhydroxy alcohol maintains pH and acid acceptance over long periods of operation.

EXAMPLE II

The procedure of Example I was followed except that the condensed methylchloroform solvent removed from the degreaser was not contacted with polyhydroxy alcohol. The results are shown in Table 2 below:

TABLE 2

| Hours of Operation | Total Mls. of $H_2O$ Added | pH/Titer Boiling Sump | pH/Titer Rinse Tank |
|---|---|---|---|
| 0.0 | — | 6.3/0.8 | 6.2/1.5 |
| 20.0 | 500 | 5.9/1.4 | 6.3/0.7 |
| 94.2 | 1400 | — | — |

TABLE 2-continued

| Hours of Operation | Total Mls. of $H_2O$ Added | pH/Titer Boiling Sump | pH/Titer Rinse Tank |
|---|---|---|---|
| 118.4 | 2500 | 5.9/1.7 | 6.3/2.5 |
| 165.9 | 4500 | 5.1/3.5 | 6.3/2.3 |
| 173.6* | 5000 | — | — |
| 189.9 | 5500 | 5.5/2.4 | 6.3/2.0 |
| 288.6 | 7000 | 5.1/3.7 | 6.2/1.2 |
| 314.7* | 8000 | — | — |
| 429.8 | 10000 | 5.0/6.0 | 5.9/0.9 |
| 430.4 | TEST TERMINATED | | |

*Ten liters of make-up solvent added to boiling sump of degreaser.

Absent treatment of the methylchloroform solvent with a continuous phase of polyhydroxy alcohol, the acidity of the solvent soon increased.

It is to be understood that although the invention has been described with specific references and specific details of embodiments thereof, it is not intended to be so limited since changes and alterations therein may be made which are within the full intended scope of this invention as defined by the appended claims.

I claim:

1. In a process for degreasing metal articles by contacting metal articles in a cleaning zone with methylchloroform solvent, said solvent stabilized by a stabilizing agent including an organic epoxide, the improvement comprising:

maintaining the acid acceptance of the solvent by continuously performing the step of removing stabilized methylchloroform solvent from the cleaning zone, treating said removed solvent by contacting it with a continuous liquid phase consisting essentially of polyhydroxy alcohol having a density lower than said solvent and having low solubility therein of less than 5.0 percent by volume, having high affinity for water, and having less than about 10 weight percent absorbed water, thereafter separating treated solvent from said polyhydroxy alcohol phase, and returning said treated solvent to the cleaning zone.

2. The process of claim 1 wherein the polyhydroxy alcohol is glycerol.

3. The process of claim 1 wherein the methylchloroform solvent is contacted with the continuous liquid phase of polyhydroxy alcohol for a period of time between 0.5 seconds to 1 minute.

4. The process of claim 1 wherein the polyhydroxy alcohol phase is between 0.001 to 2 volume percent of the methylchloroform solvent.

5. In a process for degreasing metal articles by contacting metal articles in a cleaning zone with methylchloroform solvent, said solvent stabilized by a stabilizing agent including an organic epoxide, the improvement comprising:

maintaining the acid acceptance of the solvent by continuously performing the steps of removing stabilized methylchloroform solvent from the cleaning zone, cooling said solvent and separating excluded water therefrom, then treating said removed solvent by contacting it with a continuous liquid phase consisting essentially of polyhydroxy alcohol having a density lower than said solvent and having low solubility therein of less than 5.0 percent by volume, having high affinity for water, and having less than about 10 weight percent absorbed water, thereafter separating treated solvent from said polyhydroxy alcohol phase, and returning said treated solvent to the cleaning zone.

6. The process of claim 5 wherein the polyhydroxy alcohol is glycerol.

7. The process of claim 5 wherein the methylchloroform solvent is contacted with the continuous liquid phase of polyhydroxy alcohol for a period of time between 0.5 seconds to 1 minute.

8. The process of claim 5 wherein the polyhydroxy alcohol phase is between 0.001 to 2 volume percent of the methylchloroform solvent.

* * * * *